US005237712A

United States Patent [19]

Ramsay

[11] Patent Number: 5,237,712

[45] Date of Patent: * Aug. 24, 1993

[54] MATERNITY MATTRESS WITH INFLATIBLE PORTION

[76] Inventor: Keith R. Ramsay, 27270 Skye Dr. East, Farmington Hills, Mich. 48018

[ * ] Notice: The portion of the term of this patent subsequent to Jan. 24, 2008 has been disclaimed.

[21] Appl. No.: 706,700

[22] Filed: May 24, 1991

Related U.S. Application Data

[63] Continuation-in-part of Ser. No. 561,346, Aug. 1, 1990, abandoned.

[51] Int. Cl.[5] ..... A47C 27/10

[52] U.S. Cl. ..... 5/464; 5/455; 5/462

[58] Field of Search ..... 5/462, 464, 448, 449, 5/455

[56] References Cited

U.S. PATENT DOCUMENTS 3,378,862 4/1968 Skinner ..... 5/462
4,021,872 5/1977 Powell ..... 5/462
4,054,960 10/1977 Pettit et al. ..... 5/462
4,737,999 4/1988 Halverson ..... 5/464
4,819,287 4/1989 Halverson ..... 5/455
4,973,034 11/1990 Michele ..... 5/462

FOREIGN PATENT DOCUMENTS 2826074 12/1979 Fed. Rep. of Germany ..... 5/462

*Primary Examiner*—Alexander Grosz
*Attorney, Agent, or Firm*—Cantarella & Assoc.

[57] ABSTRACT

A maternity mattress which provides a cavity for accommodating the protruding abdomen of a pregnant woman as she lies in a frontally downward position upon the mattress surface. The invention includes a multi-chambered inflatable vessel centrally positioned in a mattress which forms a flat, elastic mattress surface when fully inflated which can form a cavity for supporting a pregnant woman's abdomen by adjusting the degree of inflation of the individual chambers of the inflatable vessel to allow the elastic top surface of the inflatable vessel to adapt to the configuration of the pregnant woman's protruding abdomen.

3 Claims, 1 Drawing Sheet

MATERNITY MATTRESS WITH INFLATIBLE PORTION

Accordingly, this application is a continuation-in-part of application Ser. No. 07/561,346, filed Aug. 1, 1990, now abandoned.

BACKGROUND OF THE INVENTION

1. Field of Invention

The present application relates to mattresses and is a continuation in part application of applicant's current pending application having Ser. No. 07/561,346, filed Aug. 1, 1990, which upon filing of this application is to be abandoned without dedication. More particularly, it relates to a pre-natal mattress having a depression defined upon the top surface to accommodate the protruding abdomen of a pregnant woman. During pregnancy the resultant protruding abdomen often creates difficulties in obtaining comfortable rest for the expectant mother. Sleeping upon her back or side can create back and leg discomfort from fetal pressure upon the spine and these are therefore unfavorable positions. The remaining face downwardly position which would relieve back and abdomen strain is also impractical as the protruding abdomen would preclude comfortable reclining when positioned against a flat supporting surface and possibly cause injury to the fetus. With these limiting conditions present, a number of inventions have been devised to provide a solution to this dilemma.

2. Description of the Relevant Art

U.S. Pat. No. 4,021,872, issued in 1977 to Powell entitled "Maternity Mattress" teaches a foam rubber mattress having a circular cavity defined upon its top surface; this cavity being adjustable in size by virtue of a plurality of removable disc-like members which are removed or replaced as desired.

U.S. Pat. No. 4,054,960, issued in 1977 to Pettit entitled "Inflatable Body Support Cushion Particularly to Support A Woman During Pregnancy" teaches a multi-chambered inflatable mattress having a central aperture for receiving the abdomen of a pregnant woman and a plug for filling said aperture when a flat mattress surface is desired.

Though the above identified devices are useful, they do not teach a cavity filling means which is integral with the mattress and therefore, they would not present a smooth continuous surface to lie upon when so desired, nor are the width and depth of their abdomen accommodating depressions highly adjustable to accommodate women with abdomens of varying widths and depths of protuberance.

SUMMARY OF THE INVENTION

The present invention is a mattress which can adjustably accommodate the protruding abdomen of a pregnant woman and additionally supply a flat elastic mattress surface when desired.

This device, for providing a maternal mattress includes: a mattress; a substantially circular multi-chambered vessel centrally positioned in the mattress with the top surface of the vessel being flat and contiguous with the top mattress surface. The device also includes apertures for separately filling the individual chambers of the vessel with a gas or liquid to a desired degree and valves suitable to retain the gas or liquid within the chambers. Should an inflatable mattress be desired, it too would have apertures to facilitate inflation and deflation of the mattress and valves suitable to seal the apertures.

It is an object of the present invention to provide a maternity mattress having a highly adjustable abdomen receiving depression formable in its top surface.

It is another object of the present invention to provide a maternity mattress in which the depression filling means are integral with the mattress.

It is a further object of the present invention to provide a maternity mattress which can provide a substantially smooth, elastic and continuous top surface.

A final object of the present invention is to provide a maternity mattress which is manufactured of materials which are stable, durable, lightweight, sanitary, elastic and economically practical.

DETAILED DESCRIPTION OF THE PREFERRED EMBODIMENT

Figure 1:
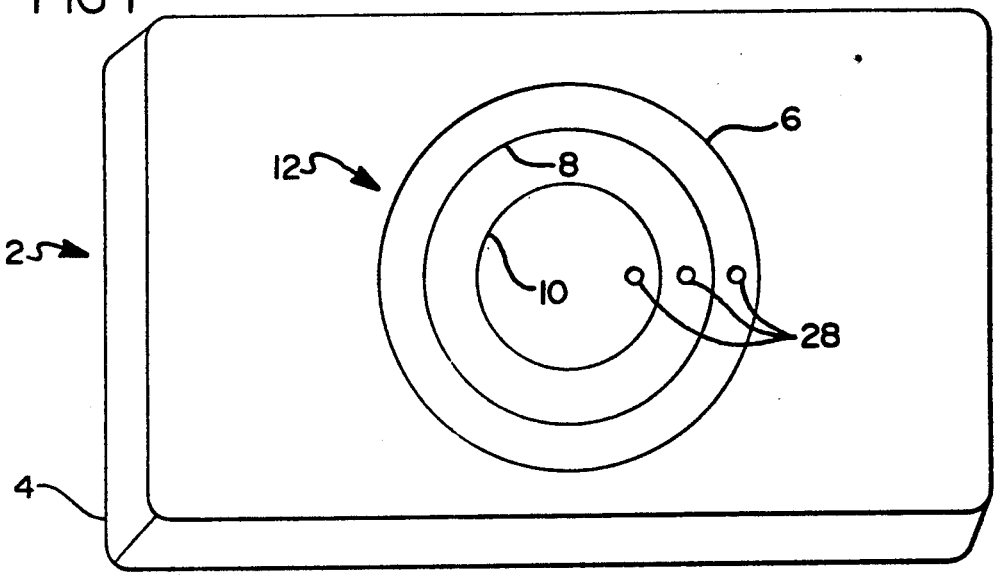
FIG. 1 shows a top view of the invention 2 and the possible position of the aperture sealing valves 28.

FIG. 1 shows that the invention 2 is configured substantially the same as a conventional mattress, not shown. FIG. 1, also shows the chambers 6, 8, and 10 of the multi-chambered vessel 12 which are centrally located in the mattress 4. Additionally, FIG. 1 shows a possible positioning of the aperture sealing valves 28 for retaining a gaseous or liquid material within the chambers 6, 8, and 10 of the multi-chambered vessel 12.

Figure 2:
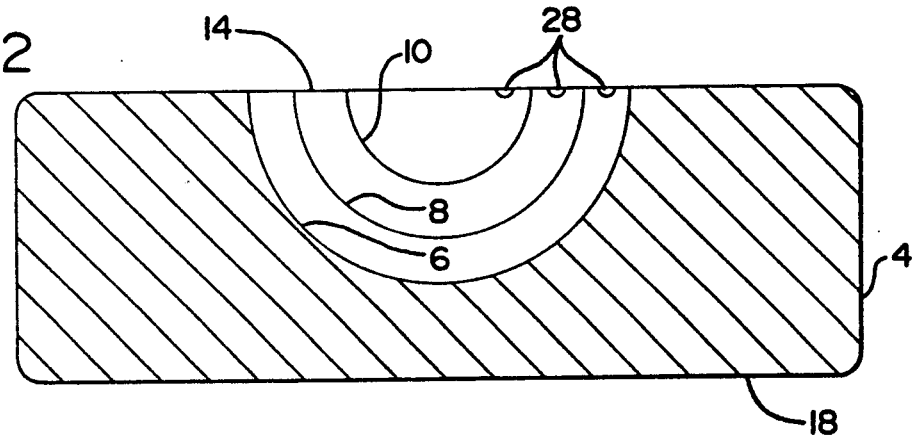
FIG. 2 shows a fragmentary cross-sectional view of the central portion of the invention 2, thereby revealing the configuration of the chambers 6, 8, and 10 of the multi-chambered vessel 12.

FIG. 2, shows a top surface 14 of chambers 6, 8, and 10 of the multi-chambered vessel 12 to be flat and substantially contiguous with the top mattress surface and that they extend downwardly from the top mattress surface in a substantially arcuate configuration which approximates the protruding abdomen 22 of a pregnant woman 26. Additionally, FIG. 2 shows the bottom mattress surface 18 to be substantially flat. Top surface 14 of chambers 6, 8, and 10 is made from an elastic material, of the type that are well known in the prior art. Such elastic materials are inherently stretchable when depressed by a protruding abdomen 22 and due to their inherent characteristics, are especially well suited for the support of the abdomen of a pregnant woman.

Figure 3:
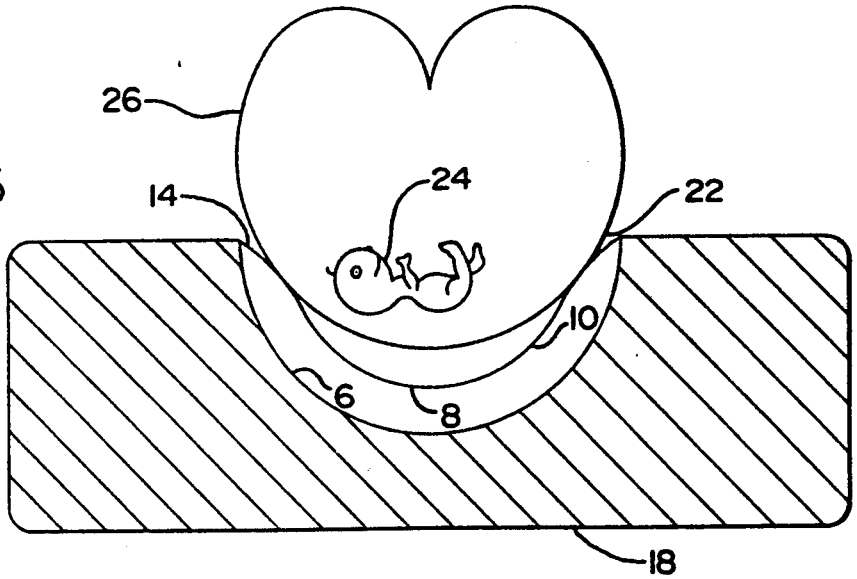
FIG. 3 shows a cross-sectional view of the invention 2 being used by a pregnant woman 26 having a protruding abdomen 22 as a result of the fetus 24 retained within her abdomen 22.

FIG. 3, shows the invention 2 being used by a pregnant woman 26 with her abdomen 22 placed against the top surface 14 of the multi-chambered vessel 12. In this view the chambers 8, and 10 are only partially filled thus allowing the top surface 14 of the multi-chambered vessel 12 to be depressed by the abdomen 22 of the pregnant woman 26, thereby providing a device described in the proceeding text.

As can be seen from the accompanying drawings and from a reading of the accompanying text a device as described is provided which is not to be limited to this embodiment and will be further understood and known from a reading of the following claims.

I claim:

1. A pre-natal mattress for supporting the body of a frontally downward lying pregnant woman, comprising in combination:

(a) a mattress;

(b) first means for adjustably adapting the top surface of said mattress to the protruding abdomen of a frontally downward pregnant woman;

(c) said mattress defining a concave depression in the top surface;

(d) an inflatable vessel operably engaged with the top surface of the mattress and the depression defined in the top surface of the mattress;

(e) said vessel defining a plurality of independently inflatable chambers;

(f) said inflatable vessel having a concave bottom surface;

(g) said vessel having an elastic top surface; and (h) said elastic top surface of the inflatable vessel defining the mattress surface above the inflatable vessel.

2. The apparatus of claim 1, further including, in combination:

(a) a plurality of releasable seals for filling and deflating said chambers of said inflatable vessel.

3. The apparatus of claim 2, wherein:

(a) said mattress is substantially configured like a conventional mattress.

* * * * *